US005788561A

United States Patent [19]

Pearlman et al.

[11] Patent Number: 5,788,561

[45] Date of Patent: Aug. 4, 1998

[54] APPARATUS FOR GRINDING FLOOR SURFACES AND/OR CUTTING GROOVES IN FLOORS

[75] Inventors: Gordon E. Pearlman, Los Angeles, Calif.; Clayton R. Peterson, Bigfork, Mont.

[73] Assignee: Pearl Abrasive Co., Commerce, Calif.

[21] Appl. No.: 879,572

[22] Filed: Jun. 20, 1997

Related U.S. Application Data

[63] Continuation of Ser. No. 584,954, Jan. 11, 1996, abandoned.

[51] Int. Cl.[6] ..... B24B 27/06

[52] U.S. Cl. ..... 451/353; 451/344; 451/350; 125/13.01; 125/4; 125/5

[58] Field of Search ..... 451/344, 353, 451/352, 350; 125/13.01, 4, 5; 30/122, 276

[56] References Cited

U.S. PATENT DOCUMENTS

| | | | |
|---|---|---|---|
| 4,188,719 | 2/1980 | Hoff | 30/122 |
| 4,479,302 | 10/1984 | Richter | 30/122 |
| 4,501,332 | 2/1985 | Straayer | 30/122 |
| 4,604,067 | 8/1986 | Roberts | 30/122 |
| 5,297,363 | 3/1994 | Schroder et al. | 451/456 |
| 5,411,433 | 5/1995 | Keller | 451/453 |
| 5,540,210 | 7/1996 | Jones | 125/13.01 |

OTHER PUBLICATIONS

Mall Tool Company Catalog No. A-3430, Apr. 1934.

Advertisement entitled "Finish Your Drywall Faster" for Model 7800 Dry Wall Sander and Model 7810 Power-Tool--Triggered Wet/Dry Vac—1994 Porter Cable Corporation.

*Primary Examiner*—Robert A. Rose
*Assistant Examiner*—George Nguyen
*Attorney, Agent, or Firm*—Sheppard, Mullin, Richter & Hampton LLP

[57] ABSTRACT

A handheld and readily maneuverable apparatus for grinding floor surfaces and/or cutting grooves in a floor formed of a hard material such as concrete, stone or the like is disclosed. The apparatus includes an elongated tube having a motor mounted at its upper end and a special rotatable abrasive head at its lower end. Rotation of the motor is coupled to the rotatable abrasive head via a flexible shaft that extends longitudinally through the elongated tube. In one form of the invention, the abrasive head includes a grinding disk that is oriented generally horizontally relative to the floor when the apparatus is in its operating orientation, and the operator can manually maneuver the apparatus so as to grind the floor surface. In an alternative form of the invention, the abrasive head includes a cutting disk that is oriented generally vertically relative to the floor when the apparatus is in its operating orientation, and the operator can manually maneuver the apparatus so as to cut grooves or enlarge cracks in the floor.

11 Claims, 6 Drawing Sheets

APPARATUS FOR GRINDING FLOOR SURFACES AND/OR CUTTING GROOVES IN FLOORS

This application is a continuation of application Ser. No. 08/584,954, filed Jan. 11, 1996, now abandoned.

BACKGROUND OF THE INVENTION

This invention relates generally to apparatus for grinding floors and/or cutting grooves in floors formed of materials such as concrete, stone or the like and, more particularly, to such apparatus that include rotatable disks incorporating an abrasive material.

Apparatus of this particular kind typically include a motor carried within a small handheld housing, with an abrasive disk mounted for rotation on the motor's output shaft. In use, the operator typically sits or kneels on the floor and manipulates the apparatus so as to grind the floor surface or to cut a groove into the floor. When the apparatus is configured as a grinder, the abrasive material is incorporated into the disk's underside, whereas when it is configured as groove cutter, the abrasive material is incorporated into the disk's peripheral edge. Disks having different abrasive materials and configurations are used according to the particular floor material that is present and the treatment that is desired.

A shroud sometimes is included, for covering the abrasive disk when the apparatus is disposed in its operative orientation. A vacuum pump and filter are connected through a port in the shroud, to draw dust-laden air from the region of the floor surface being treated and, thereby, to prevent an undesired dispersion of dust into the surrounding space.

Although the apparatus described briefly above have proven to be generally effective in grinding floor surfaces and cutting or widening grooves in floors, use of the apparatus has not proven to be entirely satisfactory. The primary reason for this dissatisfaction is that the need for the operator to sit or kneel can sometimes lead to operator fatigue and possibly injury to the operator's knees and back. Another important drawback is that such fatigue can cause the operator to grind more slowly, resulting in high labor costs for a specific project. In addition, the proximity of the rotating abrasive disk to the motor, which is being held by the operator, can sometimes lead to inadvertent injury.

Some apparatus for grinding floor surfaces and/or cutting grooves in floors are not subject to the deficiencies noted above, because they include relatively larger motors and abrasive disks mounted on wheeled supports that the operator manipulates across the floor. However, these apparatus have not proven to be entirely satisfactory, either, because they are substantially heavier, and bulkier and more expensive than the portable, handheld apparatus, and thus are substantially more difficult to maneuver about the floor.

It should, therefore, be appreciated that there is a need for an improved apparatus for grinding floor surfaces and/or cutting grooves in floors, which obviates the need for the operator to sit or kneel on the floor, yet which is lightweight and easily maneuvered by the operator. The present invention fulfills this need.

SUMMARY OF THE INVENTION

The present invention is embodied in an improved apparatus for grinding floor surfaces and/or cutting grooves in floors, which can be operated without the need for the operator to sit or kneel on the floor, yet which is lightweight, inexpensive and easily maneuvered by the operator. The apparatus includes an elongated tube configured to be held and manipulated by the operator, a rotatable, flexible shaft extending longitudinally through the tube, a motor mounted at an upper end of the tube and connected to an upper end of the shaft, and a rotatable abrasive disk disposed at a lower end of the tube and connected to a lower end of the shaft. Operation of the motor rotates the shaft and, in turn, rotates the disk, such that the disk grinds the floor surface or cuts a groove in the floor. The operator, thereby, can readily maneuver the apparatus across the floor without the need to sit or kneel on the floor.

In a more detailed feature of the invention, the apparatus further includes a shroud that covers the disk when the apparatus is disposed in its operative orientation, with the disk contacting the floor, and it further includes a vacuum/filter device that draws air through a port in the shroud, from the space beneath the shroud, to minimize the dispersion of dust when the floor surface is being ground or cut.

In one embodiment of the invention, which is configured to grind a floor surface, the elongated tube includes a generally vertical bend adjacent its lower end, and the disk is rotatable about an axis that is substantially coincident with the longitudinal axis of the tube at the lower end of the tube. The disk, thereby is oriented substantially horizontally when the apparatus is disposed in its operative orientation, with the disk contacting the floor surface. The surface of the disk that faces away from the lower end of the elongated tube incorporates an abrasive material configured to grind the floor surface. In this embodiment, the shroud has a generally inverted cup shape that covers the disk when the apparatus is in its operative orientation, and the shroud is retractable relative to the disk, along an axis substantially coincident with the disk's rotation axis. In addition, the shroud includes a cutout that exposes a circumferential portion of the tip of the disk.

In an alternative embodiment of the invention, which is configured to cut a groove into a floor, the elongated tube includes a generally horizontal bend adjacent its lower end, and the disk is rotatable about an axis that is skewed relative to the longitudinal axis of the tube, at the lower end of the tube. This rotation axis is substantially horizontal when the apparatus is disposed in its operative orientation, with the disk contacting the floor. The disk's peripheral edge incorporates an abrasive material configured to cut a groove in the floor. This embodiment further includes a wheel that is rotatably secured at the lower end of the elongated tube and configured to engage the floor and support the weight of the apparatus when the apparatus is in use. The position of the wheel's rotation axis relative to the disk's rotation axis is controllably adjustable, to control the depth of the cut being made in the floor, and the position of the shroud relative to the elongated tube is controllably adjustable, to control the visibility of the disk to the operator.

Other features and advantages of the present invention should become apparent from the following description of the preferred embodiments, taken in conjunction with the accompanying drawings, which illustrate, by way of example, the principles of the invention.

DESCRIPTION OF THE PREFERRED EMBODIMENTS

Figure 1:
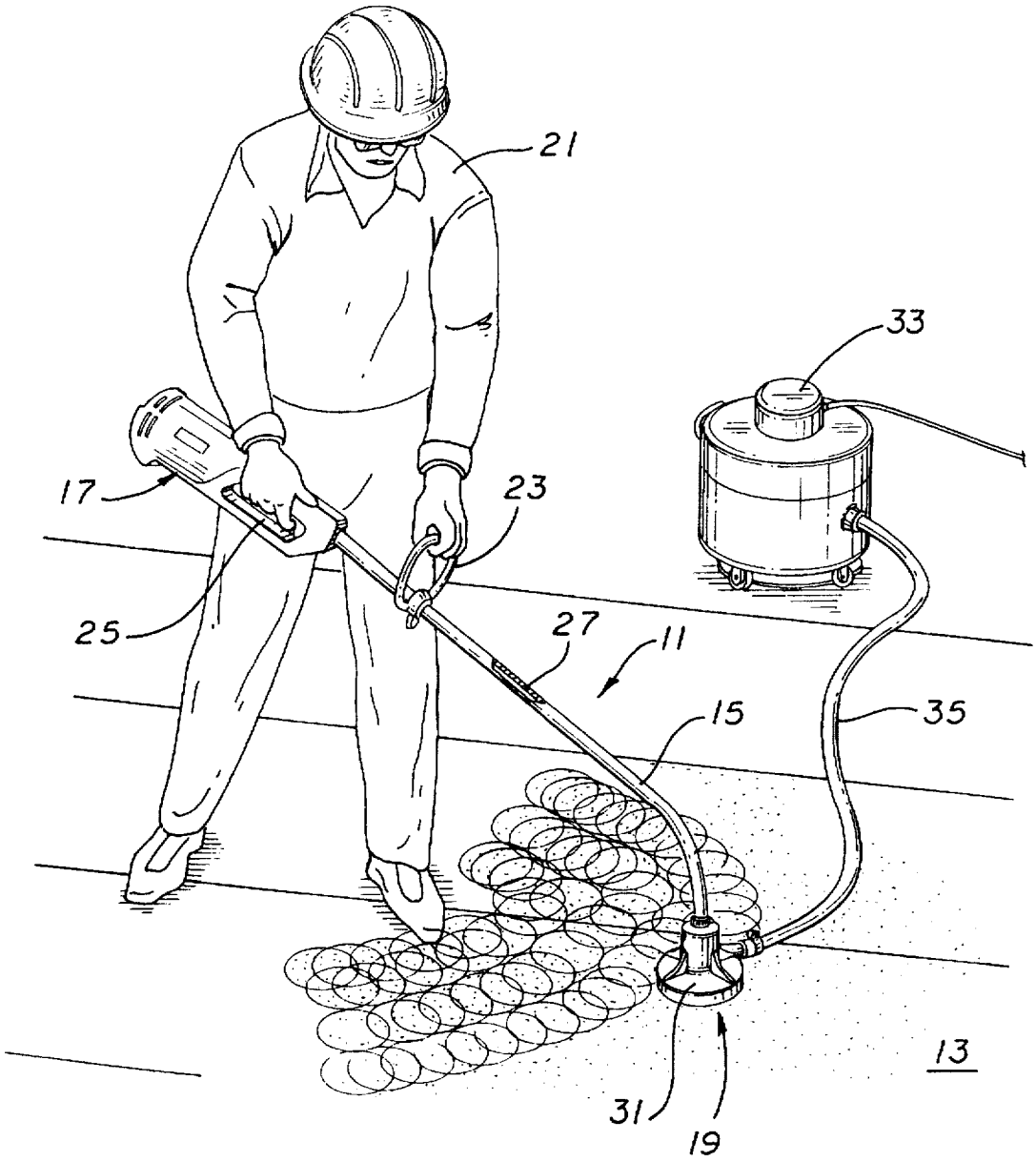
FIG. 1 is a perspective view of a grinding apparatus in accordance with a first embodiment of the invention, being used to grind a concrete floor.
Figure 2:
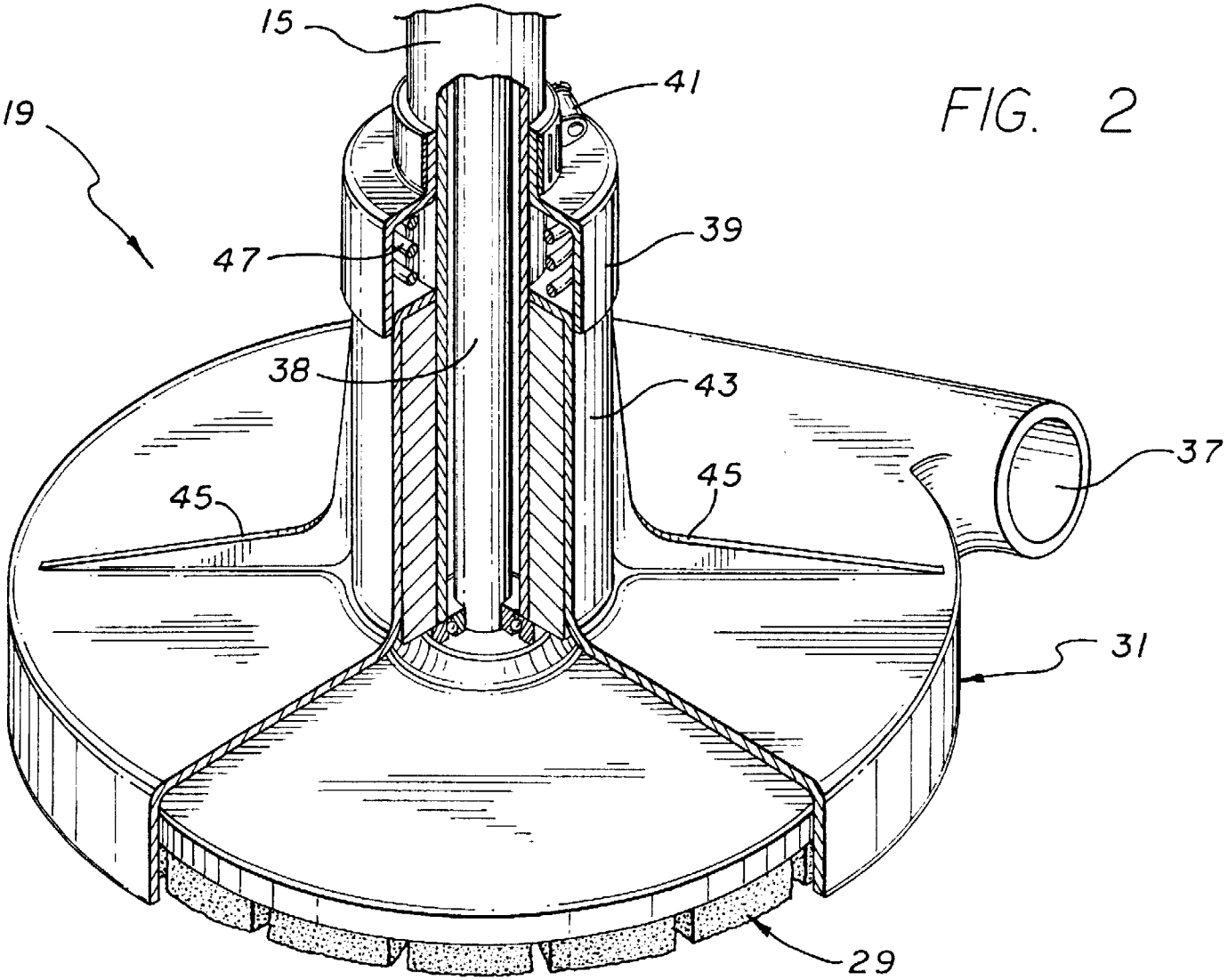
FIG. 2 is an enlarged perspective view of the head portion of the grinding apparatus of FIG. 1, with a portion of the shroud being drawn in section to reveal the connection between the flexible shaft and the abrasive grinding disk.
Figure 3:
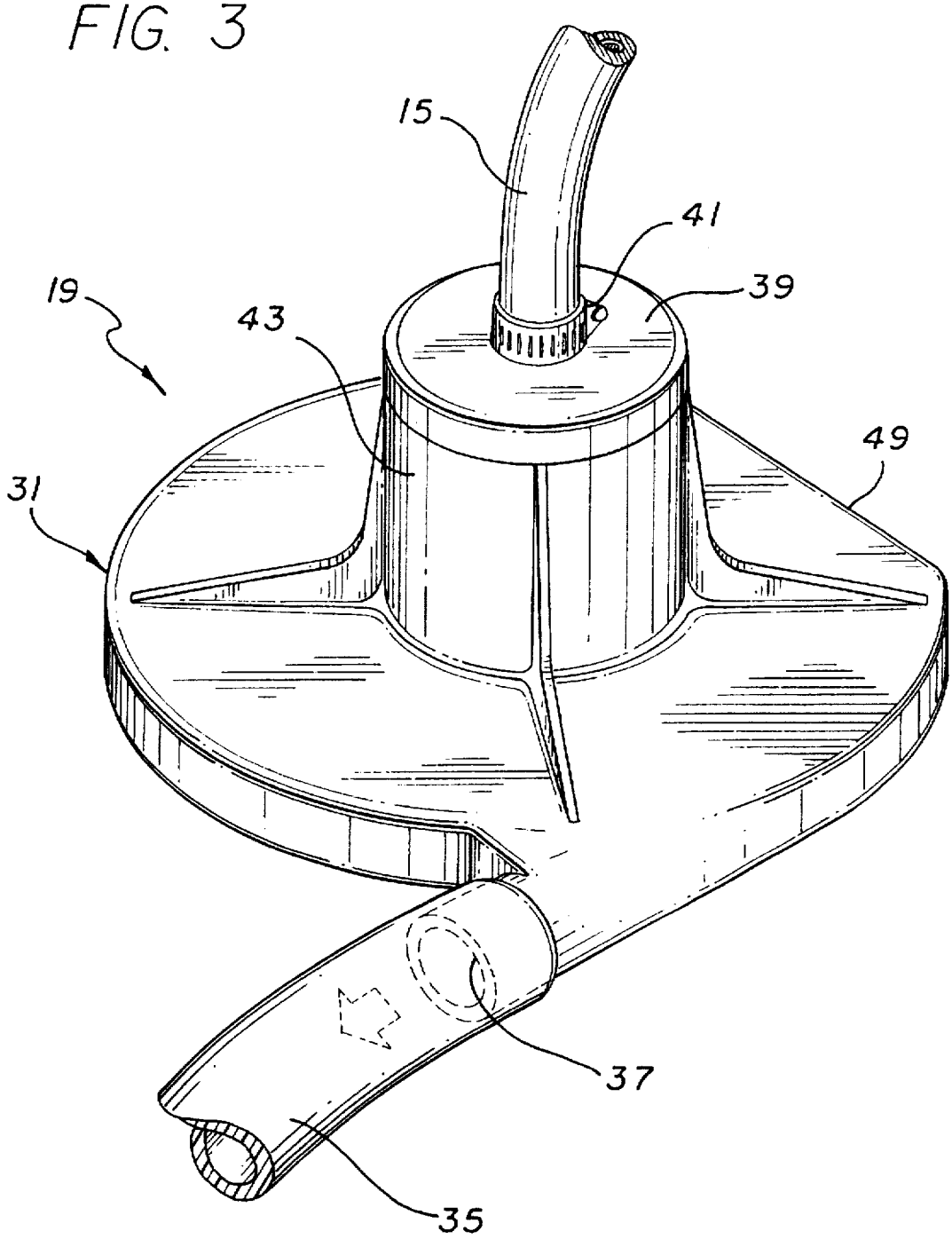
FIG. 3 is an enlarged perspective view of the shroud portion of the grinding apparatus of FIG. 1, taken from a direction opposite that of FIG. 1.
Figure 4:
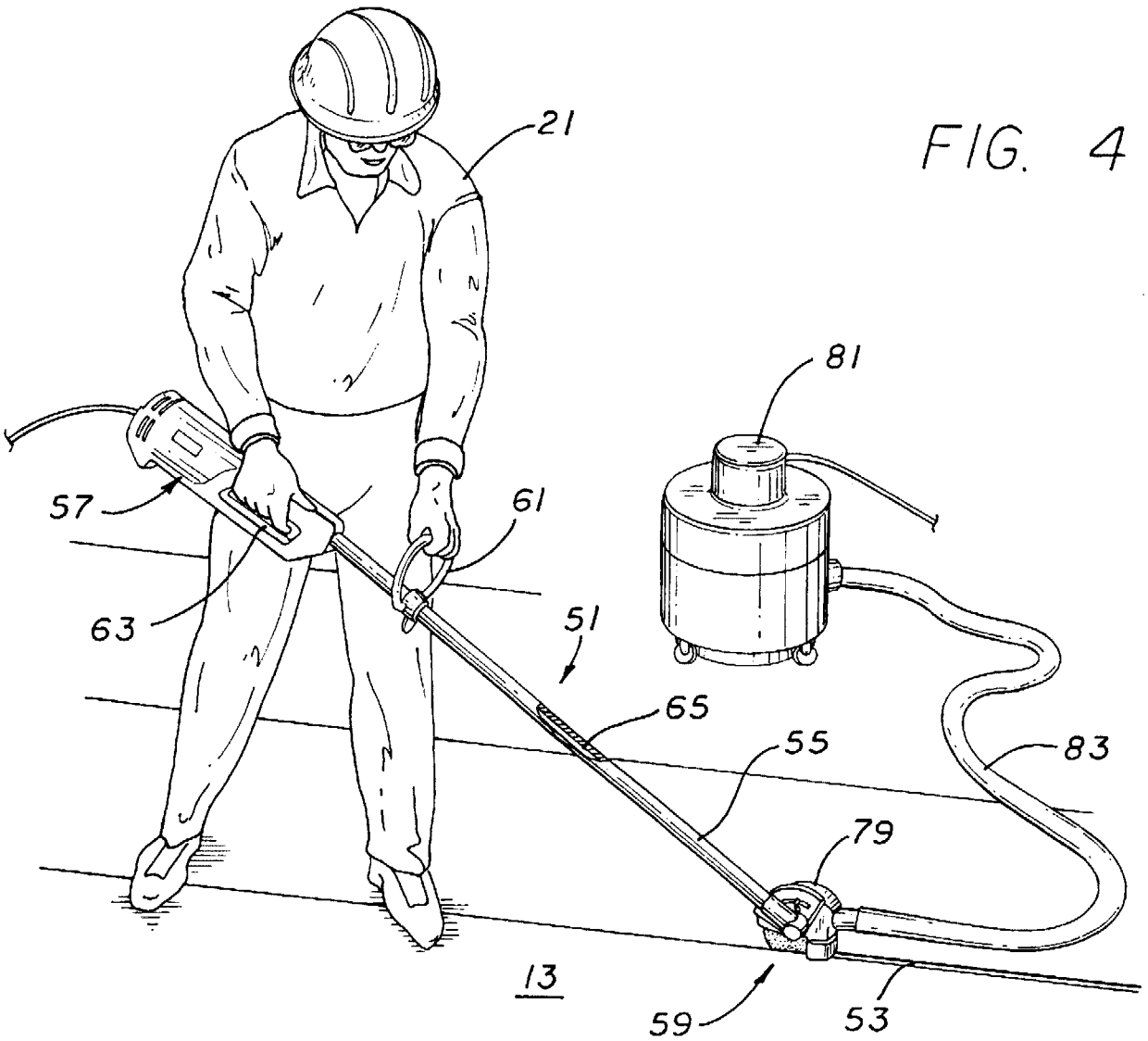
FIG. 4 is a perspective view of a groove cutting apparatus in accordance with a second embodiment of the invention, being used to cut a groove in a concrete floor.

With reference now to the drawings, and particularly to FIGS. 1–3, there is shown a portable, handheld grinding apparatus 11 in accordance with the invention, for use in grinding a floor 13 formed of a material such as concrete, stone, or the like. The apparatus includes an elongated tube 15 with a motor 17 mounted at the tube's upper end and with a special grinding head 19 mounted at the tube's lower end. An operator 21 supports the apparatus above the floor using a pair of handgrips 23 and 25. A flexible steel shaft 27 extends the length of the tube, and it is connected at its upper end to the motor and at its lower end to an abrasive grinding wheel or disk 29 that is part of the grinding head. The tube 15 includes a generally vertical bend adjacent its lower end, such that the grinding disk is oriented generally horizontally when the apparatus is disposed in its normal operative orientation, as depicted in FIG. 1. The disk's downwardly facing side is coated with a suitable abrasive material (see FIG. 2). A shroud 31 covers the upwardly facing side of the grinding disk, and a vacuum/filter device 33 is connected via a flexible tube 35 to a port 37 at the peripheral edge of the shroud, to draw dust-laden air from the area of the concrete floor 13 being ground.

The rotatable output shaft of the motor 17 is coupled directly to the upper end of the flexible shaft 27, such that rotation of the motor rotates the flexible shaft at a corresponding speed. The lower end of the flexible shaft is coupled via a rigid rotatable shaft 38 to the abrasive grinding disk 29, such that the disk likewise rotates at a corresponding speed. The disk is secured to the rigid rotatable shaft in a conventional fashion. The motor is depicted in FIG. 1 as electrically driven, although it could alternatively be gasoline driven.

The shroud 31 is depicted in greater detail in FIGS. 2 and 3. It includes an upper cup-shaped section 39 that is secured by a conventional hose clamp 41 to the lower end of the elongated tube 15, and it further includes a lower cup-shaped section 43 having a size and shape that conforms to that of the abrasive disk 29. Several ribs 45 are provided on the upwardly facing side of the shroud's lower portion, to provide strength and rigidity.

The shroud's respective upper and lower sections 39 and 43 are secured to each other such that the lower portion is retractable upwardly by contact with the floor 13, against the yielding bias of a coil spring 47. This allows the shroud 31 to accommodate to disks 29 of varying thickness. A cutout 49 along a limited circumferential portion of the shroud's periphery exposes a portion of the disk's peripheral edge and thus enables the operator 21 to maneuver the apparatus 11 such that disk is located immediately adjacent to any wall (not shown) at a border of the concrete floor being treated.

The apparatus is configured such that the abrasive disk 29 is readily replaceable, either due to wear of the disk or due to the need to use a disk adapted to provide a different kind of surface treatment. Those skilled in the art of treating surfaces of this kind are knowledgeable of the kinds of abrasive disks commercially available and of the circumstances in which each is adapted for use.

It will be appreciated that the grinding apparatus 11 can be used effectively to grind a concrete or stone floor 13 while the operator 21 remains in an erect, standing position. Moreover, the portability of the apparatus enables the operator to easily maneuver the apparatus about the floor and to orient the abrasive grinding disk 29 at any desired angle relative to the floor surface. The apparatus is relatively safe and convenient to use, and operator fatigue is minimized. Accordingly, the operator can grind more floor surface in less time than otherwise possible, thereby advantageously reducing labor costs.

With reference now to FIGS. 4–7, there is shown an alternative embodiment of the invention, this embodiment taking the form of an apparatus 51 for use in cutting or enlarging grooves 53 in a floor 13 formed of a material such as concrete, stone, or the like. Similar to the apparatus 11 of FIG. 1, this apparatus 51 includes an elongated tube 55 with a motor 57 mounted at the tube's upper end and with a special cutting head 59 mounted at the tube's lower end. The operator 21 supports the apparatus above the floor using a pair of handgrips 61 and 63. A flexible steel shaft 65 extends the length of the tube, and it is connected at its upper end to the motor and at its lower end through a beveled gear assembly 67 (FIG. 7) to an abrasive cutting wheel or disk 69 that is part of the cutting head.

Figure 5:
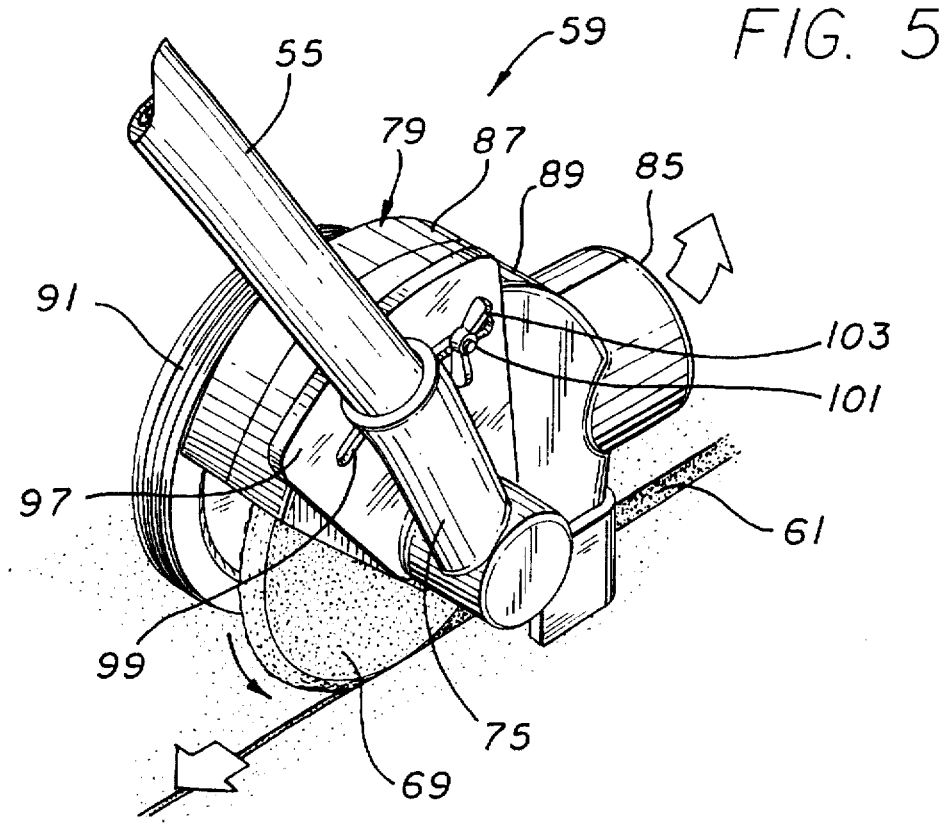
FIG. 5 is an enlarged perspective view of the head portion of the cutting apparatus of FIG. 4, taken from the same side FIG. 4.
Figure 6:
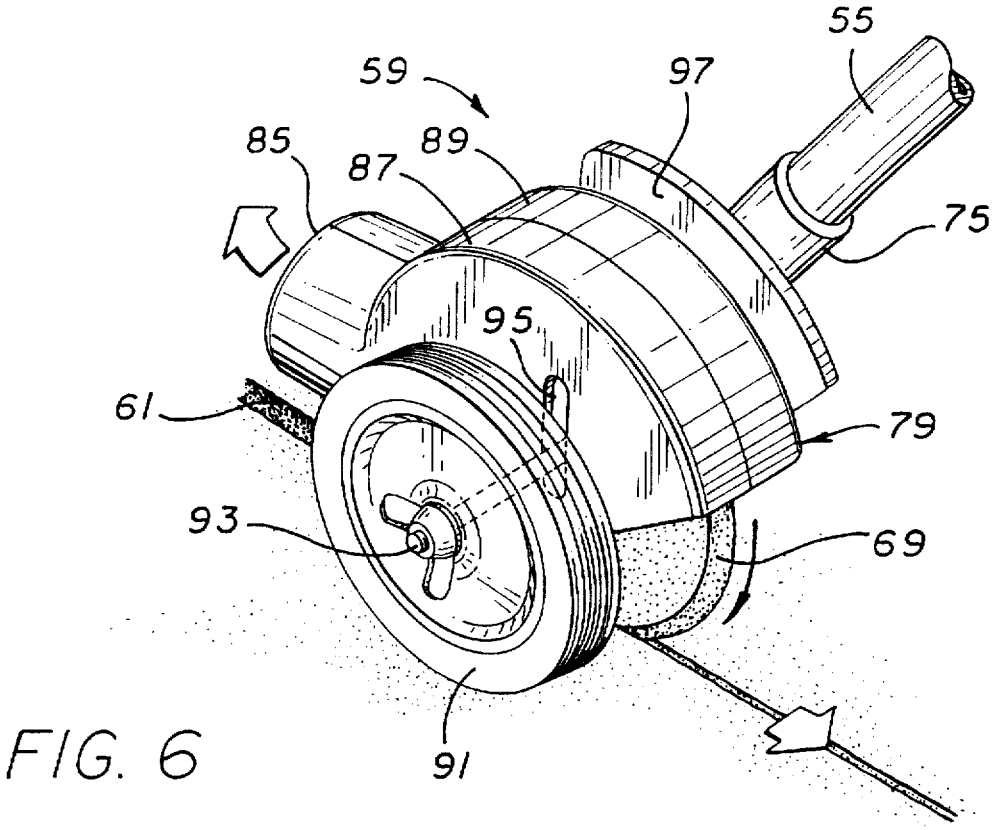
FIG. 6 is an enlarged perspective view of the head portion of the cutting apparatus of FIG. 5, taken from the side opposite that of FIG. 4.
Figure 7:
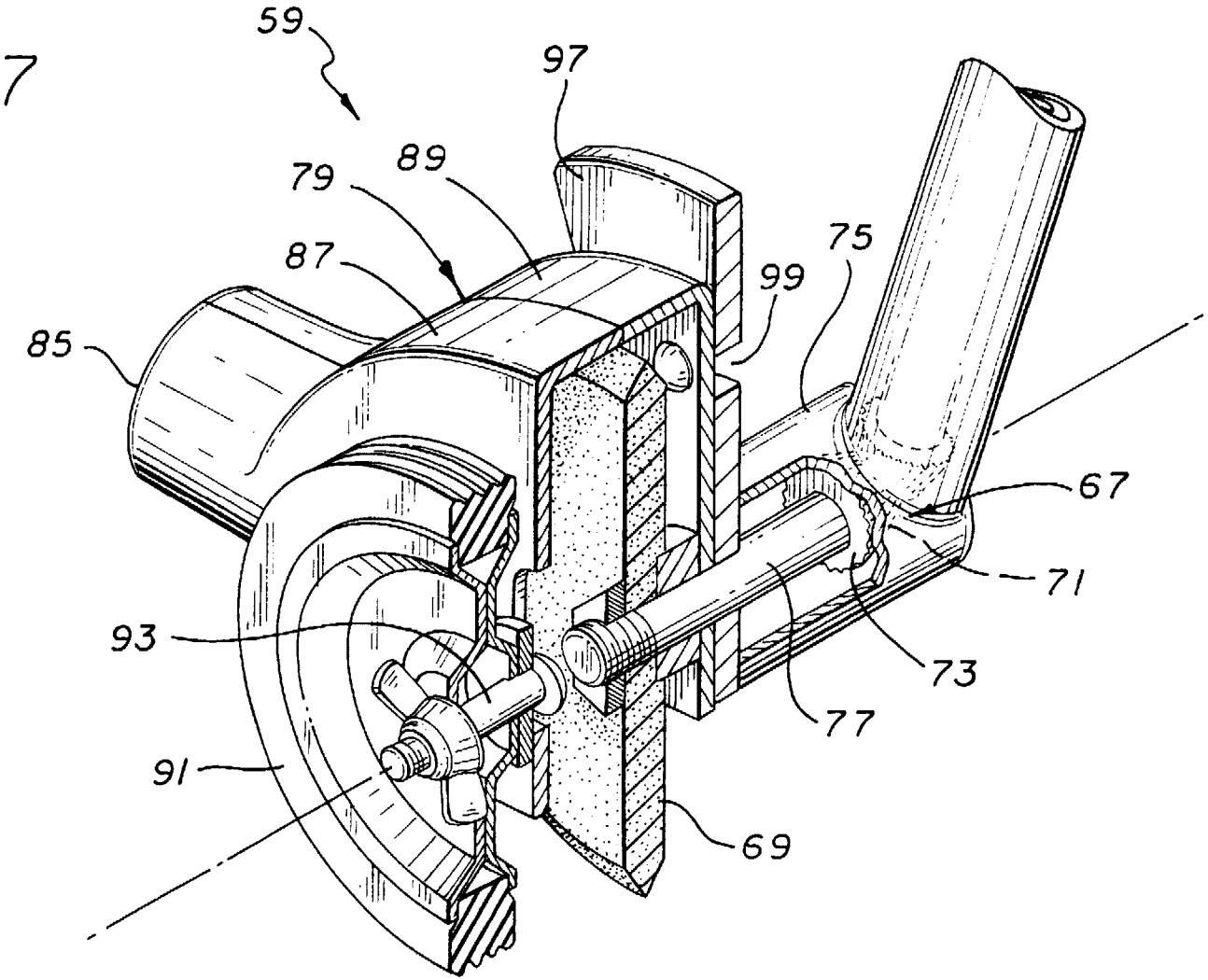
FIG. 7 is an enlarged perspective view of the head portion of the cutting apparatus of FIG. 4, with the head portion being shown in section, to reveal the connection between the flexible shaft and the abrasive cutting disk.

The beveled gear assembly 67 includes a first beveled gear 71 secured directly to the lower end of the flexible shaft 65, a second beveled gear 73 that mates with the first beveled gear, and a bracket 75 that mounts on the lower end of the tube 55 and journals the second gear. A rotatable shaft 77 projects outwardly from the second beveled gear to support the cutting disk 69. The tube includes a generally horizontal bend adjacent its lower end, such that the cutting disk is oriented generally vertically when the apparatus is disposed in its normal operative orientation, as depicted in FIG. 5. The disk's peripheral edge incorporates a suitable abrasive material.

A shroud 79 covers a major portion of the cutting disk 69, and a vacuum/filter device 81 is connected via a flexible tube 83 to a port 85 in the shroud, to draw dust-laden air from the area of the concrete floor 13 being cut. The shroud includes left and right pie-shaped sections 87 and 89, respectively, disposed on opposite sides of the disk 69. The right shroud section 89, which is disposed on the side of the disk facing the elongated tube 55, is secured in place by means of an aperture that receives the disk's rotatable shaft 77.

A support wheel 91 is mounted for rotation on a screw 93 that projects outwardly from the left shroud section 87, the wheel resting on the floor 13 and supporting the weight of the apparatus 51 while in use. The screw 93 is disposed in a vertically oriented slot 95 formed in the shroud's left section 87, to permit adjustment of the wheels vertical position. This has the effect of adjusting the depth of the groove being cut into the floor by the cutting disk 69.

A plate 97 projects upwardly from the bracket 75, parallel to and closely spaced to, the right section 89 of the shroud 79 and an arcuate slot 99 is formed in the plate to receive the shaft of an adjustment screw 101 that projects laterally from the shroud. Loosening of a wing nut 103 threaded to the screw enables the shroud to be pivoted fore and aft about a lower screw (not shown), to adjust the shroud's orientation angle so as to optimize the rotating disk's visibility to the operator 21.

It will be appreciated that the cutting apparatus 51 can be used effectively to cut or enlarge grooves 53 in a concrete or stone floor 13, while the operator 21 remains in an erect, standing position. Moreover, the portability of the apparatus enables the operator to easily maneuver the apparatus about the floor and to orient the cutting disk 69 at any desired angle relative to the floor surface. The apparatus is relatively safe and convenient to use, and operator fatigue is minimized. These advantages also result in reduced labor costs.

In an alternative form of the invention, not shown in the drawings, the elongated tube and the flexible shaft that extends through it each include an upper section and a lower section. The two sections of the tube are joined together telescopically, and they are held in place by a releasable spring-biased ball and recess combination. The two sections of the flexible shaft have mating shapes that nest with each other when the two tube sections are joined together, such that rotation of the upper shaft section is automatically coupled to the lower shaft section. This configuration enables a single motor to be used in the alternative with either a grinder disk head like that of FIGS. 1–5 or a cutting disk head like that of FIGS. 6–9.

Although the invention has been described with reference only to the presently preferred embodiments, those skilled in the art will appreciate that various modifications can be made without departing from the invention. Accordingly, the invention is defined only by the following claims.

We claim:

1. Apparatus for use by an operator to abrade a floor surface from a standing position, the apparatus comprising:

an elongated rigid tube having an upper end and a lower end and configured to be held and manipulated by an operator while in a standing position;

a rotatable, flexible shaft extending longitudinally through the tube;

a motor mounted at the upper end of the tube and connected to the upper end of the shaft; and a rotatable disk disposed at the lower end of the tube and connected to the lower end of the shaft, the disk having an abrasive surface, wherein operation of the motor rotates the shaft and, in turn, rotates the disk, such that the disk abrades the floor surface while the operator is in a standing position.

2. Apparatus as defined in claim 1, and further including:

a shroud that covers the disk when the apparatus is disposed in its operative orientation, with the disk contacting the floor, the shroud including a port; and a vacuum/filter device that draws air through the port, from the space beneath the shroud, to minimize the dispersion of dust when the floor surface is being ground or cut.

3. Apparatus as defined in claim 1, wherein:

the elongated tube includes a bend adjacent its lower end, the bend including a vertical component when the apparatus is disposed in its operative orientation, with the disk contacting the floor;

the disk is rotatable about an axis that is substantially coincident with the longitudinal axis of the tube, at the lower end of the tube; and the surface of the disk that faces away from the lower end of the elongated tube incorporates an abrasive material configured to grind the floor when the apparatus is in its operative orientation.

4. Apparatus as defined in claim 3, and further including a generally cup-shaped shroud that covers the disk when the apparatus is in its operative orientation, wherein the shroud is retractable relative to the disk, along an axis substantially coincident with the disk's rotation axis.

5. Apparatus as defined in claim 4, wherein the shroud includes a cutout that exposes a circumferential portion of the tip of the disk.

6. Apparatus as defined in claim 1, wherein:

the elongated tube includes a bend adjacent its lower end, the bend including a horizontal component when the apparatus is disposed in its operative orientation, with the disk contacting the floor;

the disk is rotatable about an axis that is skewed relative to the longitudinal axis of the tube, at the lower end of the tube, and that is substantially horizontal when the apparatus is disposed in its operative orientation; and the peripheral edge of the disk incorporates an abrasive material configured to cut a groove in the floor when the apparatus is in its operative orientation.

7. Apparatus as defined in claim 6, and further including a wheel rotatably secured at the lower end of the elongated tube and configured to engage the floor and support the weight of the apparatus when the apparatus is disposed in its operative orientation.

8. Apparatus as defined in claim 7, and further including a shroud that covers a major portion of the disk when the apparatus is disposed in its operative orientation.

9. Apparatus as defined in claim 8, wherein:

the position of the rotation axis of the wheel relative to the rotation axis of the disk is controllably adjustable, to control the depth of the cut being made in the floor; and the position of the shroud relative to the elongated tube is controllably adjustable, to control the visibility of the disk to the operator.

10. Apparatus as defined in claim 4, wherein the shroud includes:

an upper shroud section secured adjacent to the lower end of the rigid tube;

a lower shroud section slidably mounted between the upper shroud section and the lower end of the rigid tube, the lower shroud section having a cup-shaped lower end conforming to the abrasive disk; and a spring mounted between the upper shroud section and the lower shroud section to bias the lower shroud section in a direction toward the lower end of the rigid tube.

11. Apparatus as defined in claim 10, wherein the upper shroud section is cup-shaped and the lower shroud section has an upper end sized to fit within the cup-shaped upper shroud section to hold the spring therebetween.

* * * * *